US009447940B2

(12) United States Patent
Chen

(10) Patent No.: US 9,447,940 B2
(45) Date of Patent: Sep. 20, 2016

(54) VEHICLE HEADLAMP

(71) Applicant: HON HAI PRECISION INDUSTRY CO., LTD., New Taipei (TW)

(72) Inventor: Po-Chou Chen, Tu-Cheng (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 108 days.

(21) Appl. No.: 14/490,238

(22) Filed: Sep. 18, 2014

(65) Prior Publication Data

US 2016/0069525 A1 Mar. 10, 2016

(30) Foreign Application Priority Data

Sep. 9, 2014 (TW) ..... 103130971 A

(51) Int. Cl.
*F21V 9/00* (2015.01)
*F21S 8/10* (2006.01)

(52) U.S. Cl.
CPC ..... *F21S 48/1241* (2013.01); *F21S 48/1159* (2013.01); *F21S 48/1258* (2013.01); *F21S 48/1323* (2013.01); *F21S 48/145* (2013.01); *F21S 48/1747* (2013.01)

(58) Field of Classification Search
CPC ..... F21S 48/115; F21S 48/1159; F21S 48/1241; F21S 48/145
USPC ..... 362/511, 600–602, 615–616
See application file for complete search history.

(56) References Cited

U.S. PATENT DOCUMENTS 6,951,401 B2 * 10/2005 Van Hees ..... G02B 6/0031 362/555
8,419,258 B2 * 4/2013 Park ..... G02B 6/0076 362/268
8,651,725 B2 * 2/2014 Ie ..... G02B 6/0045 362/607

* cited by examiner

*Primary Examiner* — Jason Moon Han
(74) *Attorney, Agent, or Firm* — Zhigang Ma

(57) ABSTRACT

A vehicle headlamp includes a first LED light source, a first light guide plate optically coupled to the first LED light source, a second LED light source, a second light guide plate optically coupled to the second LED light source, and a light barrier sheet interposed between the first and second light guide plates. The first light guide plate is configured to guide light emitted from the first LED light source onto a predetermined area thereby creating a second light distribution pattern. The second light guide plate is configured to guide light emitted from the second LED light source onto a predetermined area thereby creating a second light distribution pattern. The light barrier sheet is configured to prevent light transmission between the first and second light guide plates.

17 Claims, 3 Drawing Sheets

VEHICLE HEADLAMP

FIELD

The subject matter herein generally relates to a vehicle headlamp, and particularly to an LED headlamp for a vehicle.

BACKGROUND

Light emitting diodes (LEDs) are solid state light emitting devices made from semiconductors, which are more stable and reliable than other conventional light sources, such as incandescent bulbs. Nowadays, LED light sources are currently widely applied for illumination, such as being used for vehicle illumination.

BRIEF DESCRIPTION OF THE DRAWINGS

Implementations of the present technology will now be described, by way of example only, with reference to the attached figures.

DETAILED DESCRIPTION

Figure 1:
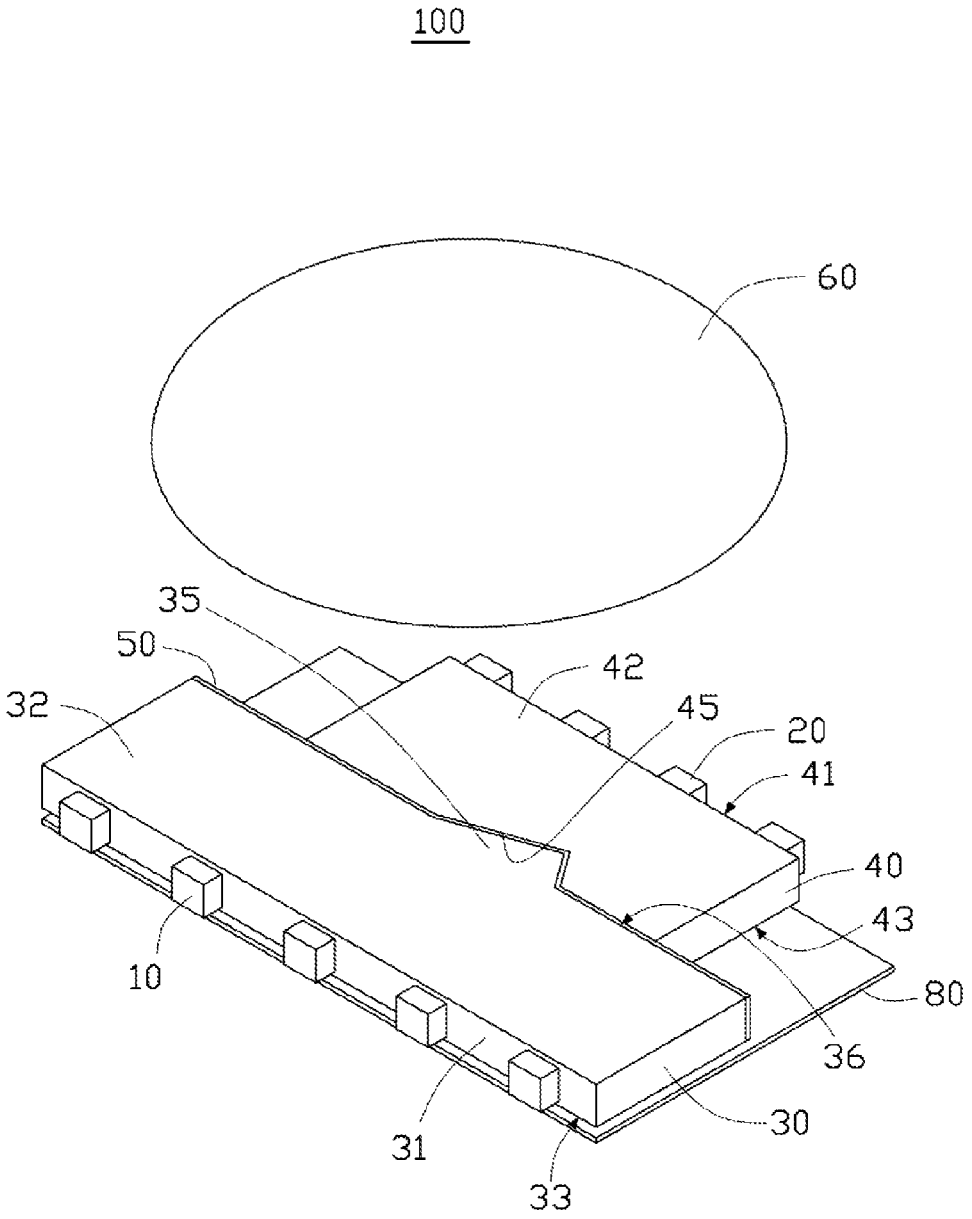
FIG. 1 is a perspective view of a vehicle headlamp in accordance with a first embodiment of the present disclosure, wherein a pair of prism sheets is omitted for clarity.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a vehicle headlamp, and particularly to an LED headlamp for a vehicle.

Figure 2:
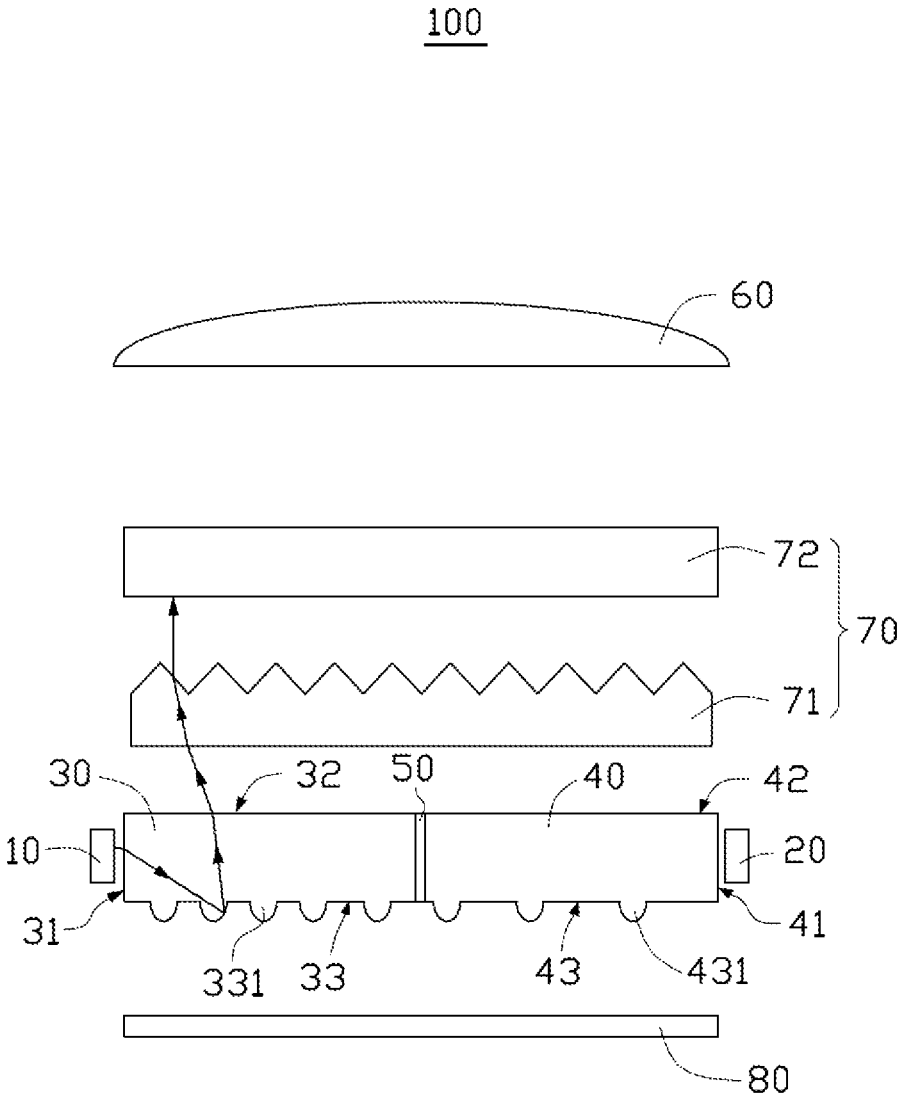
FIG. 2 is an exploded, right-side view of the vehicle headlamp of FIG. 1, together with a pair of prism sheets interposed between a first and second light guide plates and a projection lens.

Referring to FIGS. 1 and 2, a vehicle headlamp 100 in accordance with a first embodiment of the present disclosure is illustrated. The vehicle headlamp 100 includes a first LED light source 10, a first light guide plate 30 optically coupled to the first LED light source 10, a second LED light source 20, a second light guide plate 40 optically coupled to the second LED light source 20, a light barrier sheet 50 interposed between the first light guide plate 30 and the second light guide plate 40, a reflective sheet 80 located underneath the first light guide plate 30 and the second light guide plate 40, a projection lens 60 located above the first light guide plate 30 and the second light guide plate 40, and a pair of prism sheets 70, that is, a first prism sheet 71 and a second prism sheet 72, interposed between the first light guide plate 30 and the second light guide plate 40 and the projection lens 60. The light barrier sheet 50 is configured to prevent light transmission between the first light guide plate 30 and the second light guide plate 40.

The first light guide plate 30 is connected to the second light guide plate 40 via the light barrier sheet 50. The first and second light guide plates 30, 40 are arranged at opposite sides of the light barrier sheet 50 and directly connected to the light barrier sheet 50. The first and second light guide plates 30, 40 are substantially parallel and pipe-shaped and arranged side by side.

The first light guide plate 30 includes a light incident face 31, a light exit face 32 perpendicular to the light incident face 31, and a bottom face 33 opposite to the light exit face 32. The second light guide plate 40 includes a light incident face 41, a light exit face 42 perpendicular to the light incident face 41, and a bottom face 43 opposite to the light exit face 42. A thickness of the first light guide plate 30 is substantially equal to a thickness of the second light guide plate 40. The light exit face 32 of the first light guide plate 30 is coplanar with the light exit face 42 of the second light guide plate 40. In the present embodiment, the light incident face 31 of the first light guide plate 30 lies at a long side thereof, the light incident face 41 of the second guide plate 40 lies at a long side thereof, and the light incident face 31 is arranged opposite to the light incident face 41. Alternatively, the light incident face 31 of the first light guide plate 30 lies at a short side thereof, the light incident face 41 of the second guide plate 40 lies at a long side thereof, and the light incident face 31 is arranged perpendicular to the light incident face 41.

The bottom faces 33, 43 are provided with a plurality of micro-pits 331, 431. The plurality of micro-pits 331, 431 can diffuse light that strikes an inner side of the first and second light guide plates 30, 40, thereby generating a uniform light distribution inside the first and second light guide plates 30, 40, respectively. Alternatively, a plurality of microstructures in a nanometer scale, such as micro-dots, can be formed on the bottom faces 30, 40 by screen printing technology, respectively.

A wedge-shaped protrusion 35 facing the second light guide plate 40 extends outwardly from a lateral side 36 of the first light guide plate 30. A wedge-shaped cut 45 corresponding to the wedge-shaped protrusion 35 is formed at a lateral side of the second light guide plate 40. The wedge-shaped protrusion 35 engages the corresponding wedge-shaped cut 45, thereby connecting the first light guide plate 30 and the second light guide 40.

The light barrier sheet 50 interposed between the first and second light guide plates 30, 40 is opaque or reflective. It is preferred that the light barrier sheet 50 is a metal sheet. A thickness of the light barrier sheet 50 is much less than a thickness of each of the first and second light guide plates 30, 40. In the present embodiment, a length of the first light guide plate 30 is larger than a length of the second light guide plate 40. The light barrier sheet 50 completely covers the lateral side 36 of the first light guide plate 30.

The first and second LED light sources 10, 20 each includes a plurality of white LEDs arranged in a line. Alternatively, the first and second LED light sources 10, 20 each includes a plurality of red, blue, and green LEDs arranged in a line, thereby generating a mixed white light inside of the first and second light guide plates 30, 40, respectively. The first and second LED light sources 10, 20 are respectively located at opposite sides of the light barrier sheet 50 and oppositely arranged with each other.

The pair of prism sheets 70 including the first and second prism sheets 71, 72 is located above the light exit faces 32, 42 of the first and second light guide plates 30, 40. Prisms on the first prism sheet 71 are oriented to be perpendicular to the orientation of prisms on the second prism sheet 72. The pair of prism sheets 70 is configured to converge light exiting from the first and second light guide plates 30, 40 along a first direction and a second direction perpendicular to the first direction in succession. The light transmitting through the pair of prism sheets 70 is projected out from the vehicle headlamp 100 by a projection lens 60 located above the pair of prism sheets 70. The projection lens 60 is a plane convex lens.

When a forward bias voltage is applied to the first LED light source 10, light emitted from the first LED light source 10 enters the first light guide plate 30, travels through the first light guide plate 30, and refracts out of the first light guide plate 30. A portion of the light that enters the light guide plate 30 and strikes the bottom face 33 is diffused by the micro-pits 331, and a portion of the light that is refracted out of the first light guide plate 30 through the bottom face 33 is reflected back into the first light guide plate 30 by the reflective sheet 80. Light exiting from the first light guide plate 30 is converged by the first and second prism sheets 71, 72 in succession, and projected out of the vehicle headlamp 100 by the projection lens 60, thereby creating a first light distribution pattern, that is, a low beam light distribution pattern.

When a forward bias is applied to the first and second LED light sources 10, 20 simultaneously, light emitted from the first and second LED light sources 10, 20 respectively enters the first and second light guide plates 30, 40, travels through the first and second light guide plates 30, 40, and refracts out of the first and second light guide plates 30, 40. The light barrier sheet 50 prevents light transmission between the first and second light guide plates 30, 40. Accordingly, light inside the first light guide plate 30 does not interfere with the light inside the second light guide plate 40. Light exiting from the first light guide plate 30 is converged by the first and second prism sheets 71, 72 in succession, and projected out of the vehicle headlamp 100 by the projection lens 60, thereby creating a first light distribution pattern on the road. Light exiting from the second light guide plate 40 is converged by the first and second prism sheets 71, 72 in succession, and then projected out of the vehicle headlamp 100 by the projection lens 60, thereby creating a second light distribution pattern on the road. The first light distribution pattern and the second light distribution pattern combine to form a continuous light distribution pattern, that is, a high beam light distribution pattern.

Figure 3:
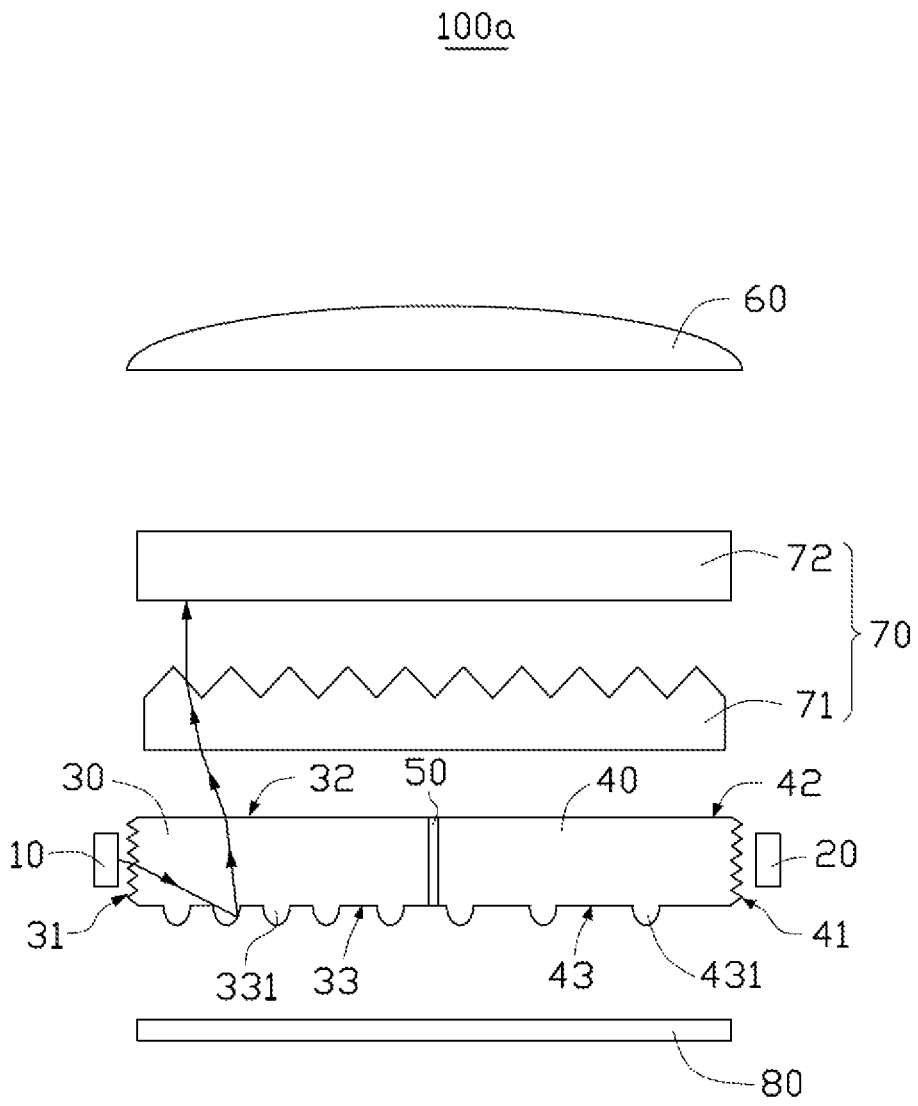
FIG. 3 is an exploded, right-side view of the vehicle headlamp in accordance with a second embodiment of the present disclosure.

Referring to FIG. 3, a vehicle headlamp 100*a* in accordance with a second embodiment is illustrated. Different from that the light incident faces 31, 41 of the first and second light guide plates 30, 40 are planar as shown in FIG. 2, the light incident faces 31, 41 of the first and second light guide plates 30, 40 are sawtooth-shaped in cross section, so as to diverge light emitted from the first and second LED light sources 10, 20 in a thickness direction, that is, a top-to-bottom direction in the plane of FIG. 3.

It is believed that the present embodiments and their advantages will be understood from the foregoing description, and it will be apparent that various changes may be made thereto without departing from the scope of the disclosure or sacrificing all of its material advantages, the examples hereinbefore described merely being preferred or exemplary embodiments.

What is claimed is:

1. A vehicle headlamp comprising:

a first light guide plate optically coupled to a first LED light source, the first light guide plate being configured to guide light emitted from the first LED light source onto a predetermined area thereby creating a first light distribution pattern, the first light guide plate being substantially parallel and pipe-shaped, the first light guide plate comprising a light incident face and a light exit face perpendicular to the light incident face;

a second light guide plate optically coupled to a second LED light source, the second light guide plate being configured to guide light emitted from the second LED light source onto a predetermined area thereby creating a second light distribution pattern, the second light guide plate being substantially parallel and pipe-shaped, the first and the second light guide plates arranged side by side, the second light guide plate comprising a light incident face and a light exit face perpendicular to the light incident face;

a light barrier sheet interposed between the first and second light guide plates, the first light guide plate connected to the second light guide plate via the light barrier sheet; and a projection lens located above the light exit faces of the first and second light guide plates, the projection lens being configured to project light out from the vehicle headlamp;

wherein the light barrier sheet is configured to prevent light transmission between the first and second light guide plates.

2. The vehicle headlamp of claim 1, wherein the first and second light guide plates are arranged at opposite sides of the light barrier sheet and directly connected to the light barrier sheet.

3. The vehicle headlamp of claim 1, wherein a thickness of the light barrier sheet is less than a thickness of the first and second light guide plates.

4. The vehicle headlamp of claim 1, wherein the light barrier sheet is opaque or reflective.

5. The vehicle headlamp of claim 4, wherein the light barrier sheet is a metal sheet.

6. The vehicle headlamp of claim 1, wherein a wedge-shaped protrusion extends outwardly from a lateral side of the first light guide plate facing the second light guide plate, a wedge-shaped cut corresponding to the wedge-shaped protrusion is defined in a lateral side of the second light guide plate, and the wedge-shaped protrusion engages into the corresponding wedge-shaped cut.

7. The vehicle headlamp of claim 1, wherein a thickness of the first light guide plate is substantially equal to a thickness of the second light guide plate.

8. The vehicle headlamp of claim 1, wherein the light exit face of the first light guide plate is coplanar with the light exit face of the second light guide plate.

9. The vehicle headlamp of claim 8, wherein the first light distribution pattern and the second light distribution pattern combine together to form a continuous light distribution pattern.

10. The vehicle headlamp of claim 1, wherein the first LED light source comprises a plurality of white LED chips arranged in a line, the second LED light source comprises a plurality of white LED chips arranged in a line, and the first and second LED light sources are oppositely arranged with each other.

11. The vehicle headlamp of claim 1, wherein the first light guide plate further comprises a bottom face opposite to the light exit face thereof, the second light guide plate further comprises a bottom face opposite to the light exit face thereof, and the bottom faces of the first and second light guide plates are respectively provided with a plurality of pits to diffuse a portion of light that strikes thereon.

12. The vehicle headlamp of claim 11, further comprising a reflective sheet located underneath the bottom faces of the first and second light guide plates to reflect light exiting from the bottom faces of the first and second light guide plates back toward the first and second light guide plates.

13. The vehicle headlamp of claim 1, wherein the projection lens is a plane convex lens.

14. The vehicle headlamp of claim 1, further comprising a pair of prism sheets including a first prism sheet and a second prism sheet, wherein the pair of prism sheets is interposed between the first and second light guide plates and the projection lens, and prisms of the first prism sheet are oriented along a direction which is perpendicular to that of prisms of the second prism sheet.

15. The vehicle headlamp of claim 1, wherein the light incident faces of the first and second light guide plates are planar.

16. The vehicle headlamp of claim 1, wherein at least one of the light incident faces of the first and second light guide plates is sawtooth-shaped in cross section.

17. A vehicle headlamp comprising:

a first LED light source;

a first light guide plate optically coupled to the first LED light source, the first light guide plate being configured to guide light emitted from the first LED light source onto a predetermined area thereby creating a first light distribution pattern, the first light guide plate comprising a light exit face;

a second LED light source;

a second light guide plate optically coupled to the second LED light source, the second light guide plate being configured to guide light emitted from the second LED light source onto a predetermined area thereby creating a second light distribution pattern, the second light guide plate comprising a light exit face;

a light barrier sheet interposed between the first and second light guide plates and configured to prevent light transmission between the first and second light guide plates; and a projection lens located above the light exit faces of the first and second light guide plates, the projection lens being configured to project light out from the vehicle headlamp.

* * * * *